United States Patent [19]

Stahlecker et al.

[11] 4,107,957

[45] Aug. 22, 1978

[54] MOBILE PIECING DEVICE AND METHOD FOR AN OPEN END SPINNING MACHINE

[76] Inventors: Fritz Stahlecker, Josef-Neidhart-Str. 18, 7341 Bad Überkingen; Hans Stahlecker, Haldenstrasse 20, 7334 Süssen, both of Fed. Rep. of Germany

[21] Appl. No.: 792,581

[22] Filed: May 2, 1977

[30] Foreign Application Priority Data

May 11, 1976 [DE] Fed. Rep. of Germany ..... 2620806

[51] Int. Cl.[2] ..... D01H 15/00

[52] U.S. Cl. ..... 57/34 R; 57/58.89; 57/156

[58] Field of Search ..... 57/34 R, 58.89–58.95, 57/156

[56] References Cited

U.S. PATENT DOCUMENTS 3,810,352 5/1974 Miyazaki et al. ..... 57/34 R

*Primary Examiner*—Charles Gorenstein

*Attorney, Agent, or Firm*—Craig & Antonelli

[57] ABSTRACT

A method and apparatus is provided for accommodating transfer of yarn supplied by an open-end spinning machine from a mobile piecing device to a spinning assembly. The yarn transfer apparatus includes a mechanism for automatically adjusting the speed of the yarn take-off during the transfer from the piecing device to the spinning assembly, for ensuring a continuous uniform denier of the yarn produced both before, during, and after the yarn transfer movement. Preferred embodiments include mechanisms for accommodating the shortening of the travel path between the spinning rotor and a winding spool at the spinning assembly resulting during this yarn transfer. Certain embodiments include direct control of the sliver feed to the spinning rotor so as to correspond to the change in speed of the yarn take-off during the transfer, while other embodiments leave the sliver feed unaffected while adjusting the yarn take-off mechanism to avoid changes in yarn take-off speed that would otherwise affect the quality of the yarn after the piecing operation.

18 Claims, 7 Drawing Figures

MOBILE PIECING DEVICE AND METHOD FOR AN OPEN END SPINNING MACHINE

BACKGROUND AND SUMMARY OF THE INVENTION

The invention relates to a piecing device that can travel along an open end spinning machine or the like, with means for receiving a yarn end of a broken yarn from a spool of a spinning assembly, means for guiding the yarn end back to a yarn take-off passage and to a spinning rotor of the spinning assembly, means to take off the pieced yarn and wind it onto the spool of the spinning assembly, and means for transferring the running yarn to a take-off device and to a winding device of the spinning assembly. By way of background information, and as an aid to understanding the present invention, reference is hereby made to co-pending U.S. application Ser. No. 493,158, filed July 30, 1974; co-pending U.S. application Ser. No. 655,853, filed Feb. 6, 1976; U.S. Pat. No. 3,924,393; and U.S. Pat. No. 3,924,394; which applications and patents relate to and disclose apparatus and methods for piecing threads in open-end spinning machines.

In a known device (German OS 2,505,943) there is the problem that in transfer of the pieced yarn to the spinning assembly devices, the yarn deflection via the piecing device has to be reversed. In the known construction there is attention to management of the transfer of the running yarn so that it is effected as rapidly as possible, so that the drop in yarn tension associated therewith will not have too pronounced an effect on the zone of the spinning turbine, where it could lead to a break in the yarn. It has been found in practice that with piecing devices of this kind quite good piecing can be produced, but there are other irregularities in the produced yarn, particularly, thick places at a relatively long distance away from the piecing.

The invention is addressed to the problem of developing arrangements whereby the produced yarn will present no more thick places after piecing, but rather will have a uniform appearance. This problem is solved according to an important provision of the invention in that the means for taking off and winding the pieced yarn and the means for transferring the running yarn after the piecing are controlled so as to be adapted to the course of the transfer motion, whereby a uniform denier will be obtained, corresponding to the denier produced by the spinning assembly.

The invention starts from the finding that the thick places occurring at a distance from the piecing device are caused by the relatively great differences or changes in the yarn take-off rate in transferring the yarn from the piecing device to the spinning assembly in question. These differences are prevented by the invention. Directly after the piecing device, both during the guiding of the yarn into the piecing device and also during the transfer of the yarn to the spinning assembly, the same denier is produced that is spun by the spinning assembly. The invention rests on the principle that compensation of fluctuation will not work because fluctuations will already have caused changes in yarn quality. It is therefore provided that the yarn be transferred to the spinning assembly under meticulously controlled conditions, whereby the rate of yarn take-off—at least as calculated on the quantity of supplied sliver—will be kept constant, without fluctuation or disturbance.

These and other objects, features and advantages of the present invention will become more apparent from the following description when taken in connection with the accompanying drawings, which show, for purposes of illustration only, several embodiments in accordance with the present invention.

DETAILED DESCRIPTION OF THE DRAWINGS

Figure 1:
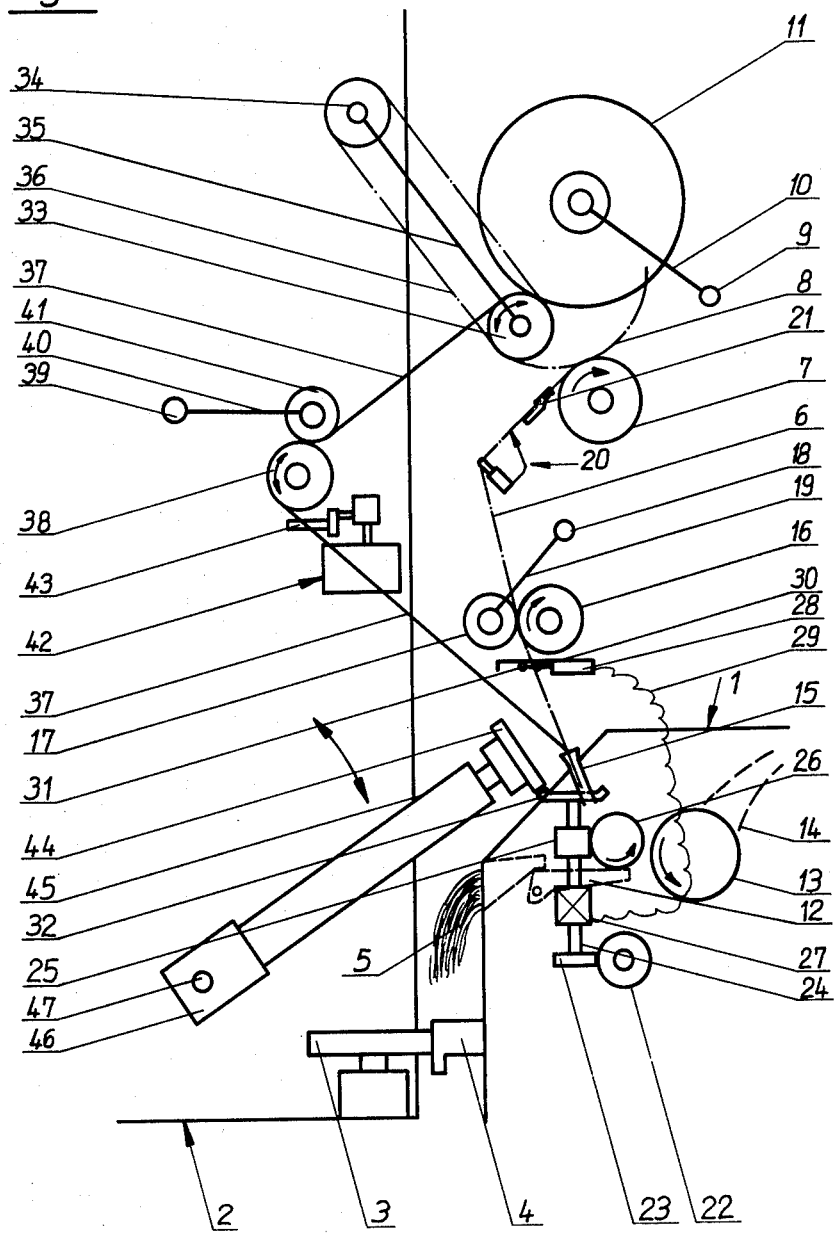
FIG. 1 is a partial schematic sectional view of a travelling servicing device and an open end spinning assembly constructed in accordance with the invention, which shows the position of key structural parts after piecing and before transfer of the pieced yarn to the spinning assembly.

A piecing device 2 which can travel along the open end spinning machine is shown moved to open end spinning assembly 1 (FIG. 1). The known piecing operation has already been effected, so that the pieced yarn 37 must be transferred from the piecing device into the yarn operational position 6 that is indicated by the dot-and-dash line. Piecing device 2 is movable on rails along the open end spinning machine, whereof only lower rail 4 is shown, whereon one or more running rollers 3 bear. A sliver 5 is supplied to open end spinning assembly 1, and said sliver is opened to individual filaments and spun in a known way, whereby a yarn is taken off into the operational position 6, said yarn being wound during the spinning process onto a spool 8 that is indicated by dot-and-dash lines indicating its normal operating position in FIG. 1. Spool 8, driven during the spinning process by a friction roll 7, is held by a spool holder 10 that is swingable about shaft 9, fixed on the machine with pivoting of spool holder 10 about shaft 9. Spool 8 is selectively swingable to lifted position 11 (FIG 1).

The supplied sliver 5 is delivered by means of a feed roll 26 that cooperates with a feed table 12, indicated by dashed lines, to a faster running opener roll 13, opened by this roll 13 to individual filaments, and carried via a delivery passage 14 to a spinning rotor that is not shown. Spun yarn 6 is taken off in the operational state from a yarn take-off passage 15 and delivered to winding spool 8. A driven roll 16 extending in the longitudinal direction of the machine and a pressure roll 17 associated with the respective individual spinning assemblies serves as take-off device, said pressure roll 17 being fixed on a holder 19 that is swingable about a shaft 18 fixed on the machine. Yarn 6 is further guided over yarn tension equalizing means 20 and wound on spool 8 with intervention of a yarn change guide 21.

The feed device for sliver 5 is driven by a shaft that extends in the longitudinal direction of the machine, on which a gear 22 is associated with each of the respective spinning assemblies 1.A standing shaft 24 at each respective spinning assembly 1 is driven by a drive gear 23, which shaft 24, via another gear 25, correspondingly drives a gear of fed roll 26. Between gears 23 and 25 there is a coupling 27 (advantageously electromagnetic) connected in a known way by an electric lead 29 with a yarn monitor 28, which coupling interrupts the drive of gear 25 for feed roll 26 when there is a break in the yarn. For sensing the spun yarn 6 in operation, there is a yarn sensor 30 for yarn monitor 28, which in operation is forced back by yarn 6, and which after a break in the yarn assumes position 31. There is another gear 32 connected with standing shaft 24. Its function will be described later on.

During the actual piecing operation the winding spool 8 is in the raised position 11. For moving spool 8 to position 11, the travelling piecing device 2 has a lift-off roll 33 that can be driven in either rotative direction, said roll 33, via a holder 35, being swingable by means of an adjusting device about a shaft 34 on piecing device 2. This adjusting device is not illustrated in order not to obscure the invention and since the same could be a simple mechanism utilizing driven gears or the like to swing holder 35 about shaft 34. Roll 33 is driven by a belt 36 from an electric drive motor that can be smoothly adjusted, disposed in the region of shaft 34. Yarn that is to be pieced is led into piecing device 2 during the piecing process (see yarn path 37) and is temporarily clamped by a pair of take-off rolls 38, 41 on piecing device 2. Advantageously roll 38 is driven synchronously with lift-off roll 33 which is also driven via a smoothly adjustable drive motor. The associated pressure roll 41 is swingable by means of a holder 40, about shaft 39 of piecing device 2. On piecing device 2 there is also a yarn transfer device 42 whose transfer lever 43 delivers the pieced yarn 37 to position 6 of spinning assembly 1 (see also FIG. 3). As shown in FIG. 1, the length of yarn path 37 undergoes shortening when it is transferred to position 6. This means that the taken off yarn length, calculated on the quantity of supplied sliver 5, would change unless special ancillary measures were provided.

Figure 2:
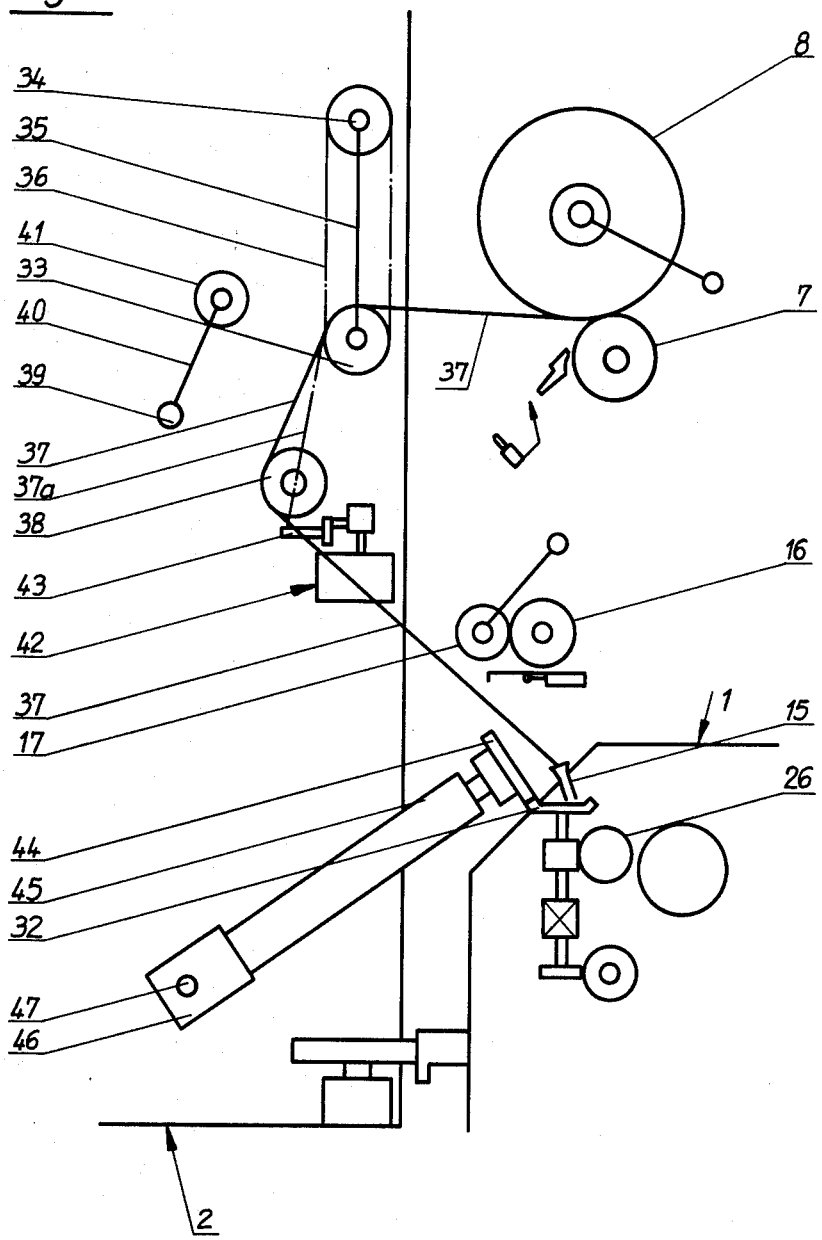
FIG. 2 is a view similar to FIG. 1, with the parts illustrated during transfer of the running yarn.
Figure 3:
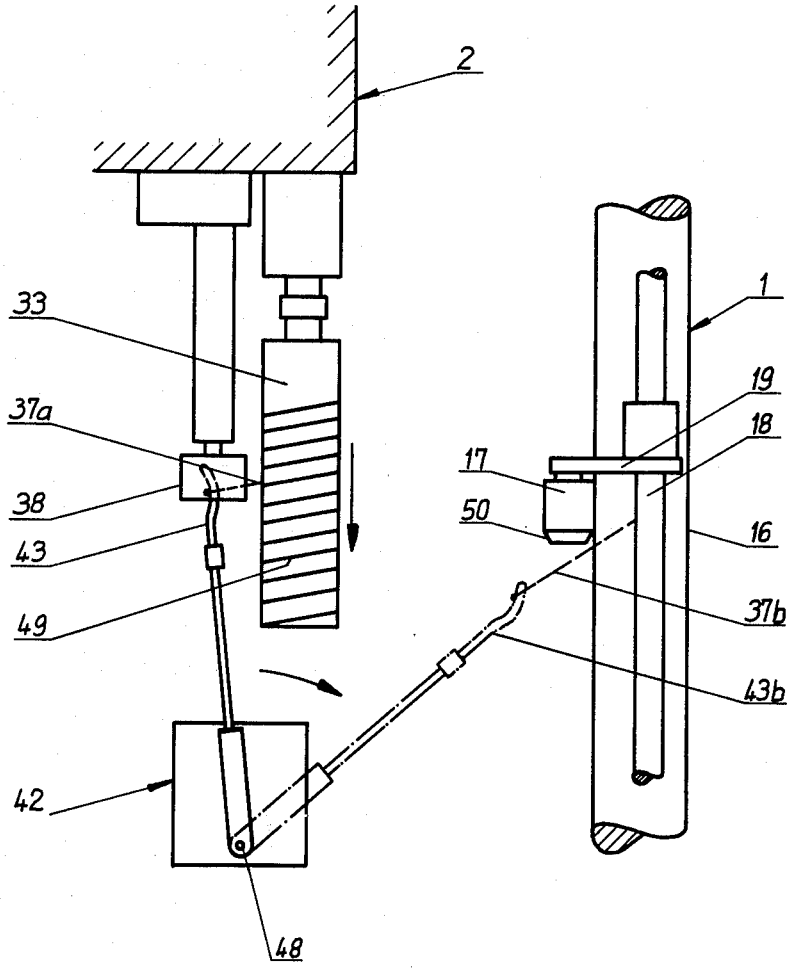
FIG. 3 is a top view of a detail of FIG. 2.

Piecing device 2 of FIGS. 1 to 3 also has an arm 45 that is swingable about a shaft 47, on which arm there is a gear 44 drivable by a motor 46. Arm 45 can be swung in either direction as indicated by the double arrow, and can be brought into engagement with previously mentioned gear 32 of the feed device of the spinning assembly 1. This device allows regulation of the speed of feed roll 26, and thereby of the quantity of sliver 5 that is supplied. The control of this device (motor 46 and therewith, gear 32) is such that the supplied amount of sliver 5 is adapted to the change in length of the yarn in the transfer from path 37 to the dot-and-dash position 6 and the associated reduction in the speed of yarn take-off. That is, motor 46 is slowed down during transfer of the yarn in a predetermined manner so as to maintain supply of sliver 5 in proper relation to the speed of drawing off or taking off the yarn during this transfer. Regulation of motor 46 is also effected for adjusting a suitable amount of sliver for the piecing process prior to the transfer.

FIG. 2 shows the apparatus of FIG. 1 at a somewhat later point. For the sake of simplicity, some structural parts are left out, or no longer given reference numerals. Yarn 37 which in FIG. 1 was still clamped by rolls 38, 41 is now transferred to position **37*a* shown in dot-and-dash lines in FIG. 2, where it no longer lies on ancillary take-off roll 38 but is guided solely by yarn transfer lever 43. The actual transfer is described in more detail later in conjunction with FIG. 3. It is further to be noted that winding spool 8 is now applied again on friction roll 7 of spinning assembly 1, that lift-off roll 33 is lifted from spool 8, and finally that pressure roll 41 of the paired ancillary take-off rolls is lifted from driven take-off roll 38. Basically it is an advantage, and this applies also for embodiments described later, if paired rolls 38, 41 are so disposed in piecing device 2 that they are very close to the normal operational path of the yarn, because then the yarn deflection caused by the take-off rolls is very slight. The adjusting means for these swinging motions are not shown in FIG. 2 because they can be readily constructed using known elements by those skilled in the art, given the present description of the desired mechanical movements. Drive means 44 to 47 of the travelling piecing device 2 engage gear 32 of the drive for feed roll 26 for sliver feed during the yarn transfer, as described above. Drive means 44 to 47 are controlled by a program control for piecing device 2. Such program control determines and controls the switching time for triggering the transfer of the yarn using an rpm counter on take-off roll 38 to monitor the time when a yarn take-off speed is reached that corresponds to the predetermined operational take-off speed of spinning assembly 1. Once the operational take-off speed has been established and detected, the program control switches and controls the motors for implementing the above-noted yarn transfer sequence, while also providing for the above-noted predetermined control of the speed of motor 46 governing the sliver feed to accommodate the reduced take-off rate experienced during yarn transfer due to the difference in length of yarn paths 37 and 6**.

FIG. 3 shows only the driven take-off roll 16 and its associated pressure roll 17, of spinning assembly 1, said roll 17 being swingable about shaft 18, fixed on the machine, by means of holder 19. FIG. 3 shows take-off roll 38, yarn transfer device 42 with transfer lever 43, and lift-off roll 33 of piecing device 2. Roll 33 has winding grooves 49, so that with a suitable rotation of lift-off roll 33, yarn 37 that is to be transferred from ancillary take-off roll 38 to yarn transfer lever 43 will be guided into position **37*a*. Yarn transfer lever 43 is moved over by a motor-controlled swinging motion about shaft 48, into position 43*b*. By means of a bevel 50 of pressure roll 17, yarn 37*b* then arrives in the clamping nip of paired take-off rolls 16, 17 of spinning assembly 1. We see that yarn 37*a, b* during the transfer to spinning assembly 1 is no longer controlled by paired ancillary rolls 38, 41, whereby however—because of the described control that engages the feed drive of spinning assembly 1—equalizing is attained. Transfer of running yarn 37** is only schematically indicated. In practice, care is taken so that this transfer will be in a steady movement, without jerks. In transfer of this kind, a yarn is produced during this work step that corresponds to the rest of the yarn, as to yarn count in proportion to yarn cross section, but it presents small deviations in twist. These have no disturbing effect on further processing.

Figure 4:
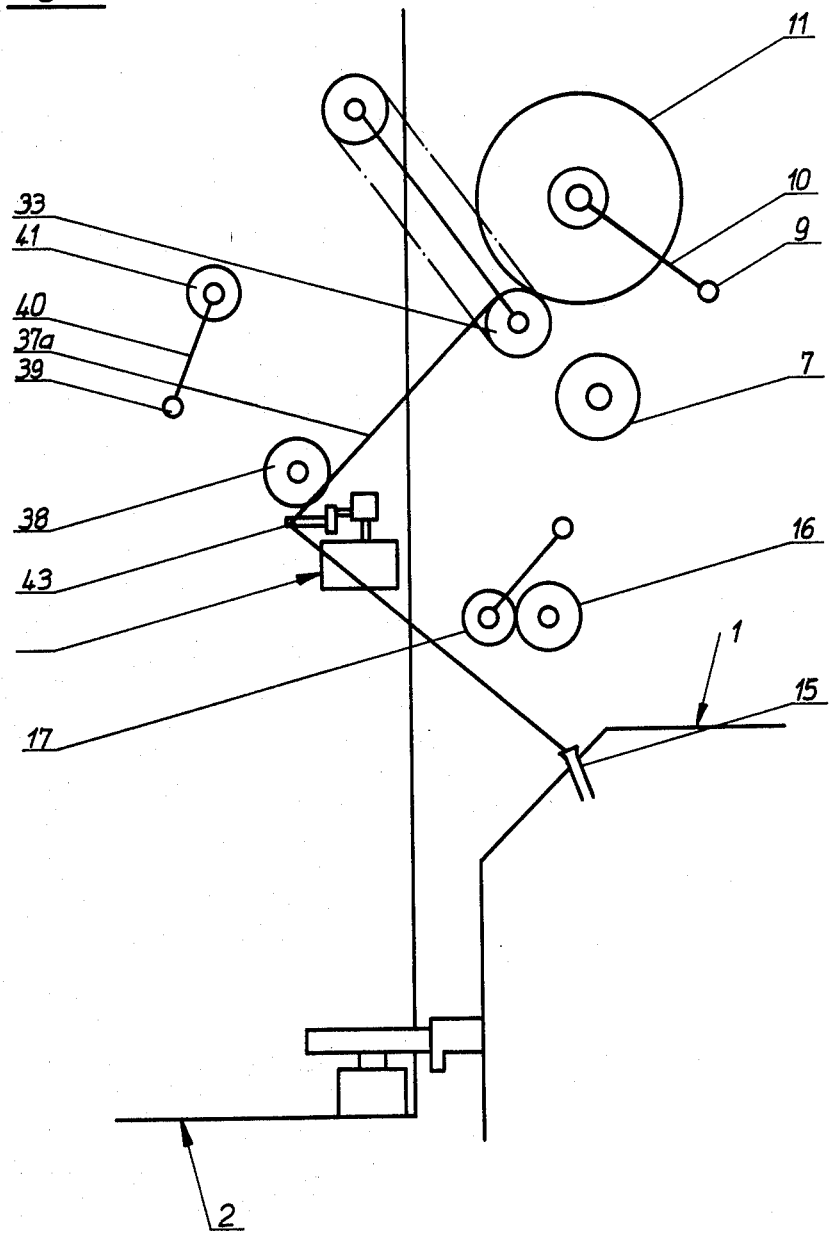
FIG. 4 is a partial schematic sectional view through another embodiment of a piecing device and a spinning assembly.

FIG. 4 shows a form of embodiment in which there is no intervention or direct control of sliver feed to spinning assembly 1. During yarn transfer, the winding spool remains in position 11, i.e. applied to lift-off roll 33 with no friction from friction roll 7. Length equalizing of yarn 37*a* that is to be transferred is effected by a controlled change of the speed of lift-off roll 33. The speed of lift-off roll 33 is controlled by the program control of piecing device 2 during transfer in such a way that the rate of yarn take-off determined solely by lift-off roll 33 remains uniform, while the additional length of yarn is wound. Thus as the yarn is taken over from paired take-off rolls 16, 17 of the spinning assembly, lift-off roll 33, adjusted to a speed corresponding to the operational winding speed, is lowered by a setting device of the program control so that the spool is taken over by friction roll 7.

Figure 5:
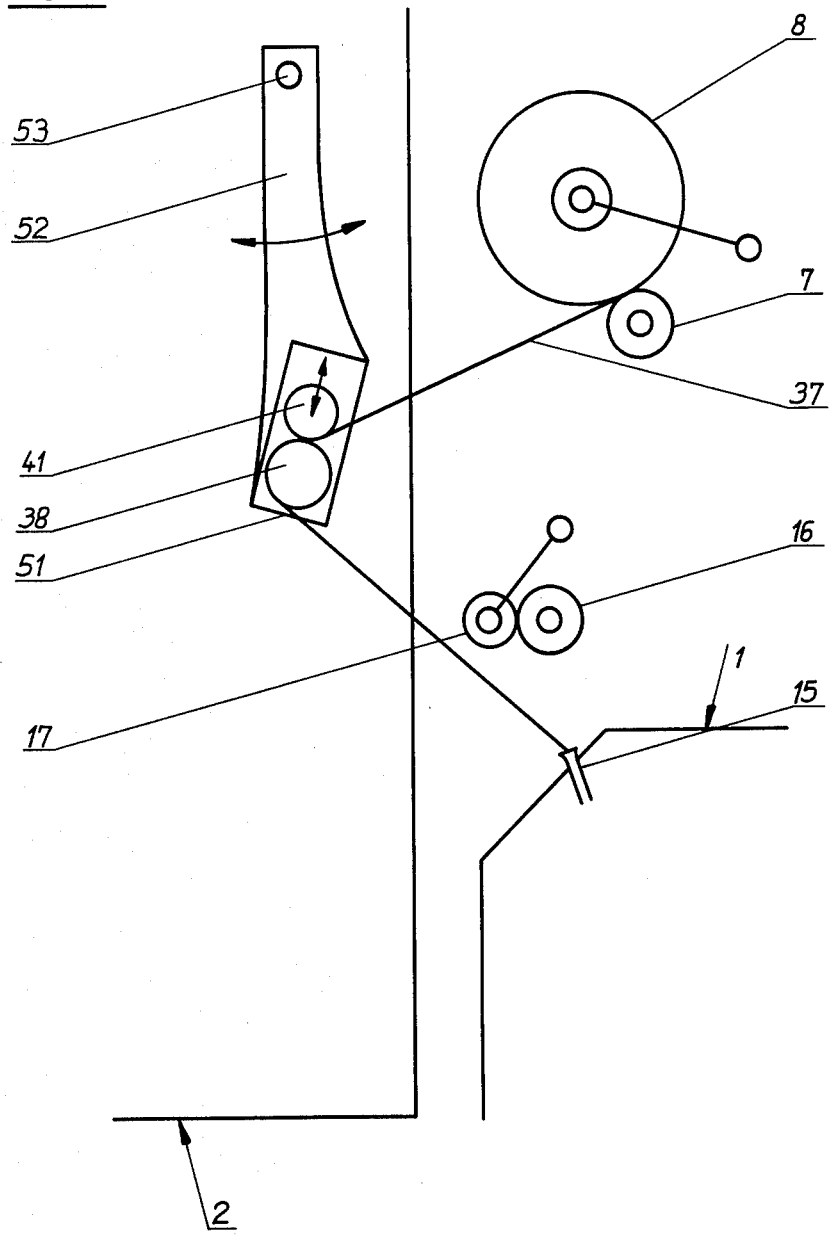
FIG. 5 is a partial schematic sectional view through yet another embodiment with a pair of take-off rolls on the piecing device which can be aligned with the spinning assembly.

There is also no intervention on the drive or control of sliver feed in the embodiment according to FIG. 5. However, the winding spool in its position 8 is applied on friction roll 7 of spinning assembly 1, while yarn 37 to be transferred is guided by paired ancillary rolls 38, 41 of piecing device 2 until it is taken over by operational paired take-off rolls 16, 17. Paired take-off rolls 38, 41 constantly control the speed of yarn 37 during its transfer to the spinning assembly. To accommodate this transfer rolls 38, 41 engaging the yarn are disposed by means of a suitable holder 51 on an arm 52 that is swingable about a shaft 53. Paired take-off rolls 38, 41 approach spinning assembly 1 during the yarn transfer. The equalizing of yarn length is effected by appropriate variation of the speed of drivable take-off roll 38, which is adjusted by the program control of the piecing device so that the take-off speed is maintained constant during transfer and corresponds to the operational yarn take off speed. For this purpose the program control included a stored average value for the speed of the roll 38, with a predetermined deviation from this average value in dependence on the position of arm 52 during transfer.

Figure 6:
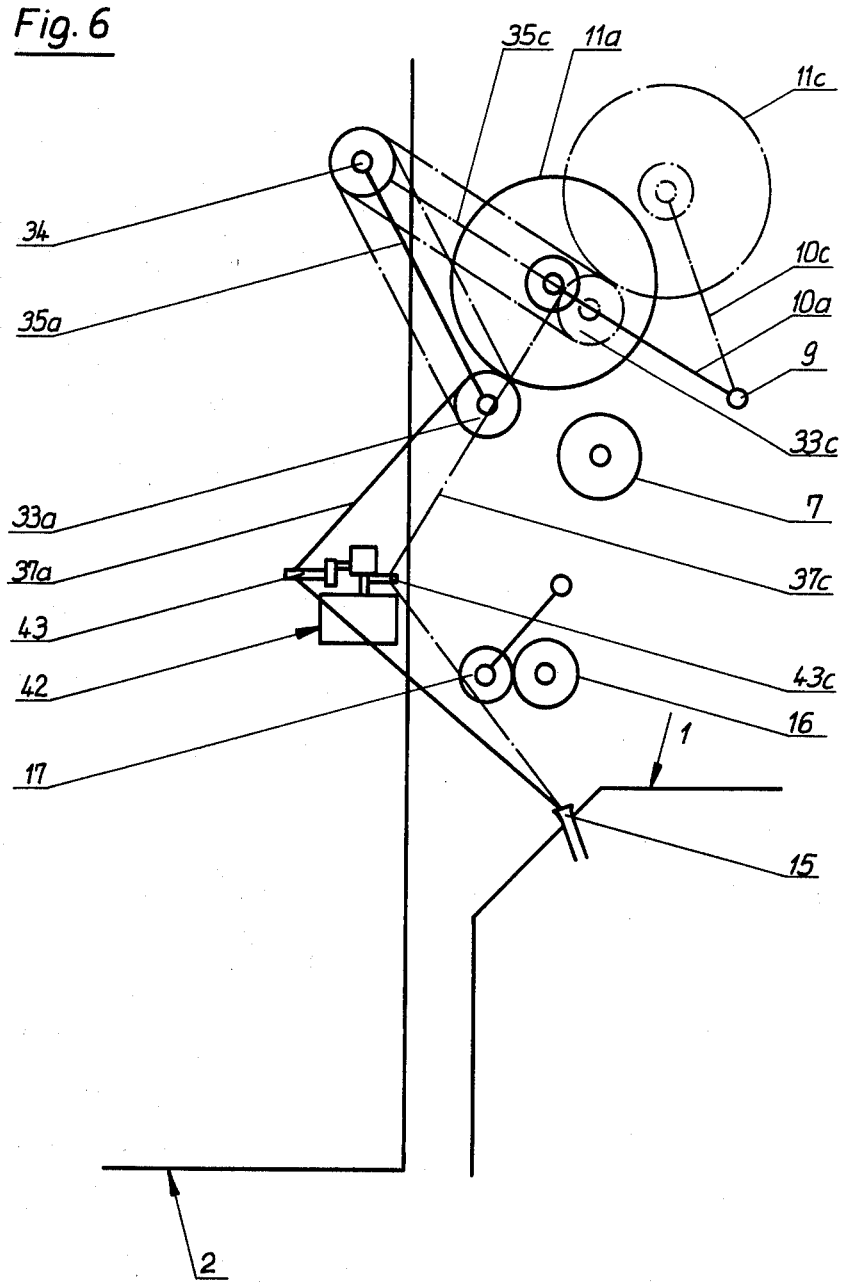
FIG. 6 is a partial schematic sectional view through another embodiment with different positions during the controlled yarn transfer being depicted.

FIG. 6 shows an embodiment similar to that of FIG. 4, where supplementarily to the speed variation of lift-off roll 33 or with constant lift-off speed, a geometric yarn length equalizing is undertaken. During the yarn transfer by lever 43—two yarn positions 37*a* and 37*c* respectively are indicated. The distance between the winding spool and friction roll 7—positions 11*a* and 11*c* respectively—is controlled by lift-off roll 33. Letters *a* and *c* respectively, following the reference numerals, symbolize two different positions in the course of yarn transfer. Swing arm 35 with lift-off roll 33 swings so much that the length of the yarn to be transferred, in leaving the other guide means, remains almost uniform just as in the case of the take-off rate that is determined by lift-off roll 33. Slight differences in yarn length can then be equalized by a change in the speed of lift-off roll 33. The yarn is thereby transferred to paired take-off rolls 16, 17 of spinning assembly 1. Lift-off roll 33 is then lowered with reduction of the winding speed to the operational speed, until the spool is applied to friction roll 7. The speed regulation is such that during the lowering, in spite of the shortening of the yarn length, a uniform winding tension will be sustained. The geometric yarn length equalizing, i.e. the catching up of the loop in the piecing device as in FIG. 6, may also be done by a lever provided specially for the purpose, disposed between the paired take-off rolls and lift-off roll 33.

In the embodiment of FIG. 6, care should be taken, that transfer of the yarn to paired take-off rolls 16, 17 of spinning assembly 1 be effected as soon as possible, so that any drop in winding tension will be limited to a short period. This could also be managed according to another contemplated embodiment by a supplementary device if the yarn is clamped and taken off by paired take-off rolls 38, 41 which are not shown, i.e. before the yarn is taken over by transfer device 43.

Figure 7:
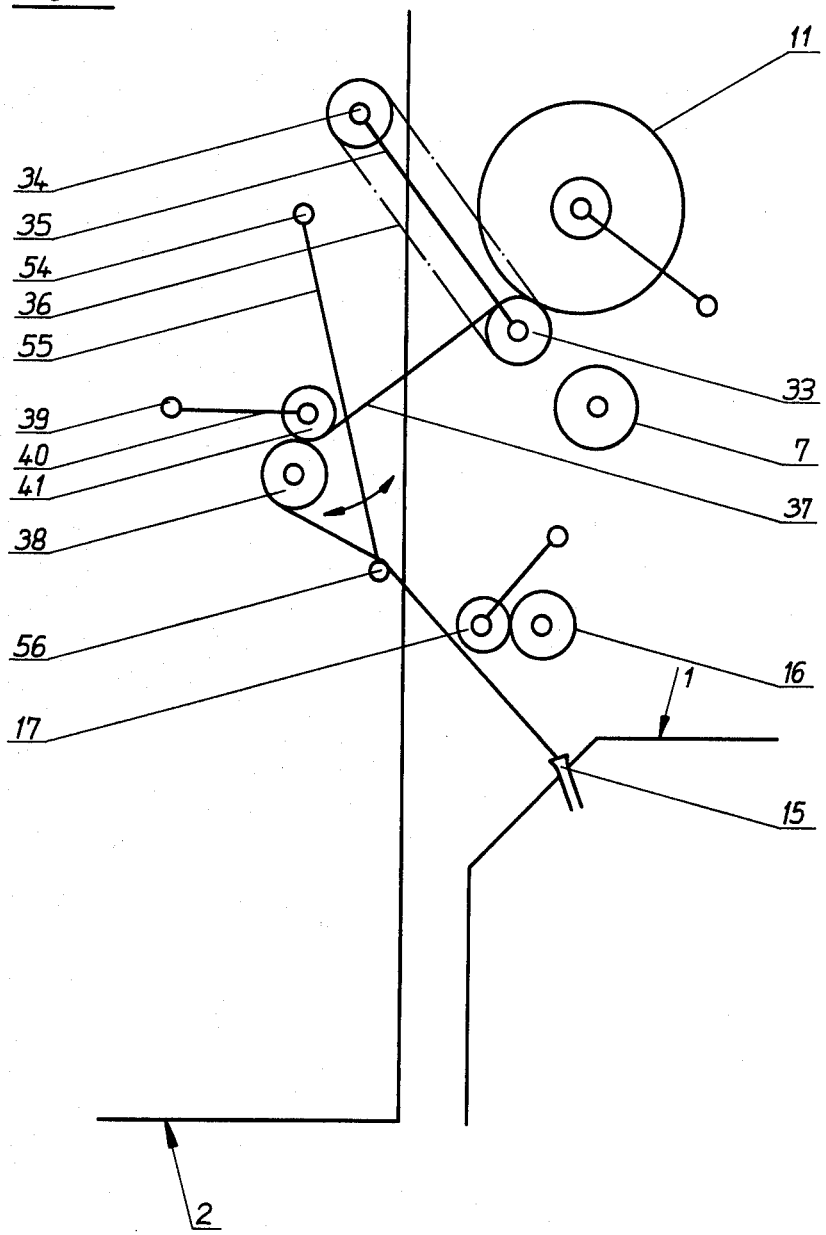
FIG. 7 is a partial schematic sectional view through another embodiment having a travelling piecing device with a delivery device for the running yarn disposed upstream of the take-off rolls in the direction of yarn take-off.

An embodiment is shown in FIG. 7 in which piecing device 2 is equipped with a pair of take-off rolls 38, 41 whereby roll 41 is made as a pressure roll which is pivotable with an arm 40 about a shaft 39 and borne so that it may be pressed against take-off roll 38. Take-off roll 38 has a smoothly adjustable drive motor that is not shown, which is switched from the program control of piecing device 2. Piecing device 2 further has a lift-off roll 33 disposed on a swing arm 35 which is pivotable about a shaft 34 by means of an adjustment device that is not illustrated, which likewise is actuated by the program control of piecing device 2. Lift-off roll 33 is driven via a belt 36 or the like by a drive motor that is smoothly adjustable and is borne in the region of shaft 34, said motor also being switched from the program control of piecing device 2. Piecing device 2 is additionally equipped with a yarn delivery device that comprises a lever 55, swingable about a shaft 54 by means of an adjusting device that is not illustrated, said lever 55 presenting a yarn guide element 56 at its free end which engages behind yarn 37. Actuation of the said yarn delivery device is also effected from the program control of piecing device 2. Obviously, piecing device 2 has still other elements that are needed or that at least are advantageous for the actual piecing process. These elements are omitted in FIG. 7 because we start from the state in which yarn 7 has already been pieced and taken off by paired take-off rolls 38, 41 from the yarn take-off passage 15 of spinning assembly 1 and wound by means of lift-off roll 33 on spool 11. Here a slight difference in speed between lift-off roll 33 and paired take-off rolls 38, 41 is provided, to produce a winding tension that corresponds to operational winding tension, developed by a speed differential between friction roll 7 and paired take-off rolls 16, 17 of spinning assembly 1.

Piecing device 2 is so made and so controlled that the piecing process is carried out in such a way that operational conditions that obtain on spinning assembly 1 are reached as rapidly as possible, so that as soon as possible after the piecing a yarn will be produced that corresponds in form and quality to the rest of the yarn spun in spinning assembly 1. This means that above all else, the take-off rate of paired take-off rolls 38, 41 must correspond as soon as possible to the operational speeds of the corresponding structural parts of spinning assembly 1. As soon as these conditions are obtained, there must be a transfer of running yarn 37 as quickly as possible to the parts of the spinning assembly 1 so that the piecing process will not be stretched out and delayed unnecessarily. This transfer of the running yarn occurs in a controlled and regulated way in which the operational yarn take-up rate is maintained as precisely as possible, as well as the winding tension, so that even during the transfer there will be no changes of yarn quality, and especially no thick places.

After a specific time following the start of the take-off of the pieced yarn the operational take-off speed will be reached, so that the program for yarn transfer can be started as a function of the time of triggering the take-off. However, it is more advantageous if the exact values are controlled. For this, for example take-off roll 38 can have an rpm counter associated with it, which sends a signal to program control when the operational take-off rate is attained, and triggers the work program for yarn transfer. As the first step it is then provided that running yarn 37 will be transferred by means of the yarn delivery device to paired take-off rolls, as illustrated in FIG. 3. In this transfer of yarn 37 to paired take-off rolls 16, 17 of spinning assembly 1 there is a deflection of the yarn between yarn take-off passage 15 and take-off roll 38 of piecing device 2. To prevent this deflection of the yarn from leading to a change in take-off speed of the yarn from passage 15, the drive of take-off roll 38 will be so adjusted with the program control that it will compensate this deflection, i.e. the take-off rate of paired take-off rolls 38, 41 will be correspondingly reduced. In the same proportion, the winding speed of lift-off rolls 33 will be reduced, to keep the winding tension uniform. As soon as the transfer has been executed, and paired take-off rolls 16, 17 have taken over, paired rolls 38, 41 and lift-off roll 33 are once more driven at increased speed. The transfer can be determined in various ways. For example, arm 55 may have an end switch associated with it, which switches into the transfer position and this switching is fed into the program control as a signal. This can be connected at the same time with the release of the clamping of paired take-off rolls 38, 41, whereby then pressure roll 41 is lifted off by means of a setting device that is not shown.

After the running yarn has been transferred to paired take-off rolls 16, 17 of spinning assembly 1, it is next provided that the yarn will be released from the rest of the guide elements of piecing device 2 and transferred to the spinning assembly or to its guide elements. Here the running yarn is first released from roll 38, which can be managed by a lifting device that is not illustrated. This lifting device can then transfer the yarn into the zone of friction roll 7 or other guide elements there that are not shown. To sustain the desired winding tension, either lift-off roll 33 can be lifted by means of its setting device in such a way that the intrinsic yarn deflection will be caught up.

It may also be provided that between the paired take-off rolls 38, 41 and lift-off roll 33 there be a separate deflection lever that catches up the yarn deflection by forming a loop. More advantageously, however, it may be provided that lift-off roll 33 will be driven more rapidly, to reduce the yarn deflection while retaining the desired winding tension. Thereafter, the lift-off roll will be lowered so that it will give the spool over to the friction roll 7 with reduction of the yarn deflection, whereby at the time of transfer, friction roll 7 will have the corresponding winding speed.

Differing from the above way of operating, embodiments are also contemplated where it is provided that in the first step of the yarn transfer, namely in the guiding of the yarn by means of yarn guide element 56 to paired take-off rolls 16, 17 of the spinning assembly, the take-off speed of yarn 37 will not be changed, but the sliver feed will be changed as a function of the take-off speed that changes because of the deflection, so that there is a constant ratio between the take-off rate and the quantity of the sliver feed. This has the effect that there can be no variation of cross section of the yarn, especially with respect to the number of filaments in the yarn cross section. This can be effected by a supplementary device of the travelling piecing device, which engages the sliver feed of the spinning assembly (see FIGS. 1 and 2, and description of control of feed drive gear 32). Such a device is advantageously present in piecing device 2, to produce an advantageous yarn piecing that is very little to be distinguished from the appearance and strength of the rest of the yarn. This supplementary device of FIGS. 1 and 2 is then also controlled from the program control of the piecing device during transfer of the running yarn. This is particularly useful if a yarn monitor sensor as indicated in FIG. 1 is disposed in the region of paired take-off rolls 16, 17 of the spinning assembly, so that it only takes over the switching in of the sliver feed when the yarn has been transferred to paired take-off rolls 16, 17. In this case there is no influencing of paired rolls 38, 41 and lift-off roll 33 of piecing device 2 during the transfer of the running yarn to take-off rolls 16, 17.

While we have shown and described only several embodiments in accordance with the present invention, it is understood that the same is not limited thereto but is susceptible of numerous changes and modifications as would be known to those skilled in the art, given the present disclosure, we therefore do not wish to be limited to the details shown and described herein but intend to cover all such changes and modifications as are encompassed by the scope of the appended claims.

We claim:

1. Apparatus comprising:

spinning assembly yarn take-off means for controlling the taking off of yarn produced at an open-end spinning assembly and supplied to a spool of the spinning assembly, piecing device yarn take-off means for controlling the taking off of yarn from said open-end spinning assembly during yarn piecing operations, said spinning assembly yarn take-off means exhibiting a yarn path during normal spinning operations having a different length than the yarn path through said piecing device yarn take-off means during yarn piecing operations, and yarn tranfer means for transferring said yarn from said piecing device yarn take-off means to said spinning assembly yarn take-off means, said yarn transfer means including control means for controlling the respective yarn take-off means and spinning assembly during transfer of said yarn so that a uniform denier is maintained during said transfer which corresponds to the denier produced at the spinning assembly under normal spinning operations, said control means including means for accommodating said length differences of said yarn path during normal spinning and piecing operations.

2. Apparatus according to claim 1, wherein said piecing device yarn take-off means includes means for supplying said yarn to said spool.

3. Apparatus according to claim 1, wherein said piecing device yarn take-off means is carried on a mobile piecing device which is selectively movable to servicing positions adjacent each of a plurality of spinning assemblies of a spinning machine.

4. Apparatus according to claim 1, wherein the piecing device yarn take-off means includes a paired set of take-off rolls which has a smoothly adjustable drive which is adjusted to keep uniform the yarn take-off rate during transfer of the yarn to the spinning assembly yarn take-off device.

5. Apparatus according to claim 4, wherein said adjustable drive includes means for establishing a yarn take-off rate corresponding to the yarn take-off rate of the spinning assembly yarn take-off means, preliminary to said transfer.

6. Apparatus according to claim 5, wherein the pair of take-off rolls is disposed on a movable adjusting device for selective alignment with a take-off device of the spinning assembly yarn take-off means during transfer of the running yarn.

7. Apparatus according to claim 1, wherein means are provided for winding the yarn on the spool which includes a lifting and driving lift-off roll to lift the spool from a drive of the spinning assembly winding roll, the lift-off roll being provided with a smoothly adjustable drive that is adjusted to reduce a yarn deflection caused by the guiding of the yarn in the piecing device and to remove said deflection in transfer of the running yarn.

8. Apparatus according to claim 7, wherein the piecing device yarn take-off means includes a pair of take-off rolls, wherein the yarn transfer means includes a transfer device that takes over the yarn from the pair of take-off rolls of the piecing device yarn take-off means and transfers the yarn to the spinning assembly yarn take-off means, said transfer device including an adjustment drive adjusted in tune with the adjustable drive of the lift-off roll.

9. Apparatus according to claim 7, wherein the adjustable drive for the lift-off roll is in tune with an adjustable tuning drive thereof.

10. Apparatus according to claim 1, wherein said control means includes means controlling the amount of sliver feed to the spinning assembly and which means are adjusted as a function of the varying yarn take-off speed which occurs in the course of transfer of the running yarn to the spinning assembly yarn take-off means.

11. Apparatus according to claim 10, wherein the yarn transfer means includes guide means that approach the spinning assembly yarn take-off means and a winding device of the spinning assembly with a steady movement.

12. Apparatus comprising:

spinning assembly yarn take-off means for controlling the taking off of yarn produced at an open-end spinning assembly and supplied to a spool of the spinning assembly, piecing device yarn take-off means for controlling the taking off of yarn from said open-end spinning assembly during yarn piecing operations, and yarn tranfer means for transferring said yarn from said piecing device yarn take-off means to said spinning assembly yarn take-off means, said yarn tranfer means including control means for controlling the respective yarn take-off means and spinning assembly during transfer of said yarn so that a uniform denier is maintained during said transfer which corresponds to the denier produced at the spinning assembly under normal spinning operations, wherein the piecing device yarn take-off means includes a paired set of take-off rolls which has a smoothly adjustable drive which is adjusted to keep uniform the yarn take-off rate during transfer of the yarn to the spinning assembly yarn take-off device, wherein said adjustable drive includes means for establishing a yarn take-off rate corresponding to the yarn take-off rate of the spinning assembly yarn take-off means, preliminary to said transfer, wherein, upstream of the pair of take-off rolls in the direction of yarn take-off, there is a yarn delivery device which can be aligned with a take-off device of the spinning assembly yarn take-off means.

13. Apparatus according to claim 12, wherein the adjustable drive of the take-off rolls and the yarn delivery device, respectively, are switched by a control program that controls the piecing process.

14. Apparatus according to claim 13, wherein the control program is connected with an rpm counter connected with the pair of take-off rolls.

15. Apparatus comprising:

spinning assembly yarn take-off means for controlling the taking off of yarn produced at an open-end spinning assembly and supplied to a spool of the spinning assembly, piecing device yarn take-off means for controlling the taking off of yarn from said open-end spinning assembly during yarn piecing operations, and yarn transfer means for transferring said yarn from said piecing device yarn take-off means to said spinning assembly yarn take-off means, said yarn transfer means including control means for controlling the rrespective yarn take-off means and spinning assembly during transfer of said yarn so that a uniform denier is maintained during said transfer which corresponds to the denier produced at the spinning assembly under normal spinning operations, wherein the piecing device yarn take-off means incudes a paired set of take-off rolls which has a smoothly adjustable drive which is adjusted to keep uniform the yarn take-off rate during transfer of the yarn to the spinning assembly yarn take-off device, wherein said adjustable drive includes means for establishing a yarn take-off rate corresponding to the yarn take-off rate of the spinning assembly yarn take-off means, preliminary to said transfer, wherein the pair of take-off rolls is disposed on a movable adjusting device for selective alignment with a take-off device of the spinning assembly yarn take-off means during transfer of the running yarn, wherein the adjustable drive of the take-off rolls and the adjusting device, respectively, are switched by a control program that controls the piecing process.

16. Apparatus according to claim 15, wherein the control program is connected with an rpm counter connected with the pair of take-off rolls.

17. A method of operating an open-end spinning machine including:

piecing an end of yarn wound on a spool at a spinning assembly with fibers in a spinning rotor of said spinning assembly, by means of a mobile piecing device, taking off of yarn produced after said piecing by means of a piecing device yarn take-off means carried by said piecing device, and transferring said yarn from said piecing device yarn take-off means to spinning assembly yarn take-off means at said spinning assembly, said spinning assembly yarn take-off means exhibiting a yarn path during normal spinning operations having a different length than the yarn path through said piecing device yarn take-off means during yarn piecing operations, wherein said transferring includes controlling the respective yarn take-off means and spinning assembly during transfer so that a uniform denier is maintained during said transfer which corresponds to the denier produced at the spinning assembly under normal spinning operations, said controlling including accommodating for said length differences of said yarn path during normal spinning and piecing operations.

18. A method according to claim 17, wherein said controlling includes controlling the amount of sliver feed to the spinning assembly as a function of the varying yarn take-off off speed which occurs in the course of transfer of the yarn running yarn to the spinning assembly yarn take-off means.

* * * * *